United States Patent [19]

Pridy

[11] 4,329,124

[45] May 11, 1982

[54] CONNECTOR ASSEMBLY

[76] Inventor: Whetstine B. Pridy, 3610 Long Beach Blvd., Long Beach, Calif. 90807

[21] Appl. No.: 180,843

[22] Filed: Aug. 25, 1980

[51] Int. Cl.[3] ..... F04B 47/02; F16D 1/12

[52] U.S. Cl. ..... 417/545; 403/77; 403/343; 166/242

[58] Field of Search ..... 403/77, 19, 133, 134, 403/137, 146, 148, 149, 80; 166/206, 68, 72, 73, 242; 76/101 A; 52/726; 29/505; 417/450, 452, 453

[56] References Cited

U.S. PATENT DOCUMENTS

| | | | |
|---|---|---|---|
| 323,805 | 8/1885 | Griscom | 417/453 |
| 1,788,363 | 1/1931 | Brooks | 403/19 |
| 1,912,095 | 5/1933 | Randall | 403/77 |
| 2,694,549 | 11/1954 | James | 175/73 |
| 2,900,028 | 8/1959 | Hanes | 166/242 |
| 3,367,421 | 2/1968 | Raulins | 166/242 |
| 3,854,557 | 12/1974 | Wilcox | 403/133 |
| 4,091,881 | 5/1978 | Maus | 175/72 |
| 4,139,334 | 2/1979 | Payne et al. | 417/545 |

*Primary Examiner*—William L. Freeh
*Assistant Examiner*—D. Kearney
*Attorney, Agent, or Firm*—William C. Babcock

[57] ABSTRACT

A connector assembly that may be used to so pivotally connect the adjoining end portions of an upper and lower string of sucker rod that are angularly disposed relative to one another within a tubing string of like angulation, that longitudinal forces may be exerted on the sucker rod strings to reciprocate the same without the sucker rod strings being subjected to an appreciable twisting stress. The connector assemblies may not only be used to connect angularly disposed strings of sucker rod at their junctions, but also to connect the lower end of the lowermost string of sucker rod to the piston rod of an elongate pump situated below the tubing string in which the sucker rods are disposed. The strings of sucker rod and the piston rod when so connected by the connector assemblies of the present invention, permit the sucker rods and pump to be moved downwardly through a tubing string having a number of longitudinally spaced angulations therein without difficulty, and dispose the pump adjacent a fluid producing zone in an oil well bore. The pump and sucker rod strings when connected by the connector assemblies may be drawn upwardly through the angulated tubing for maintenance purposed when so required.

4 Claims, 4 Drawing Figures

FIG. 1
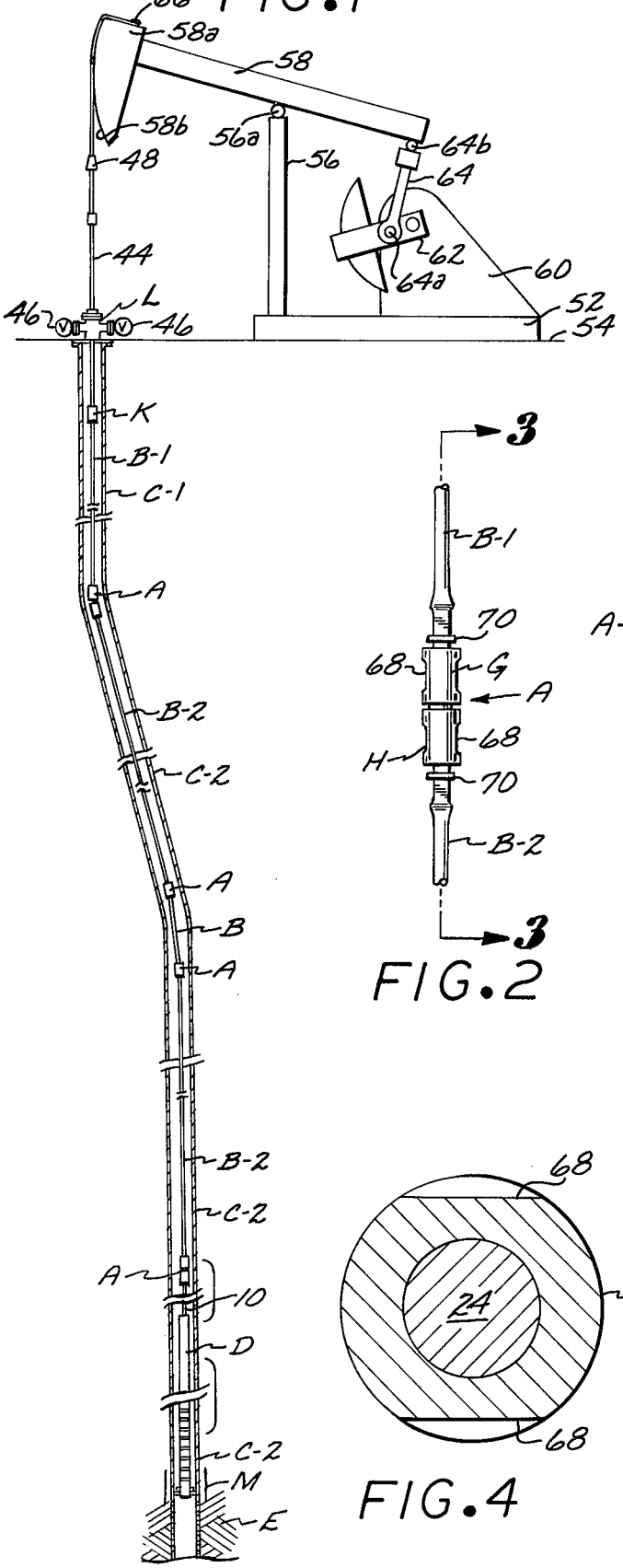
FIG. 2
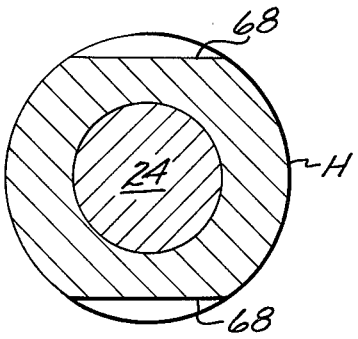
FIG. 4
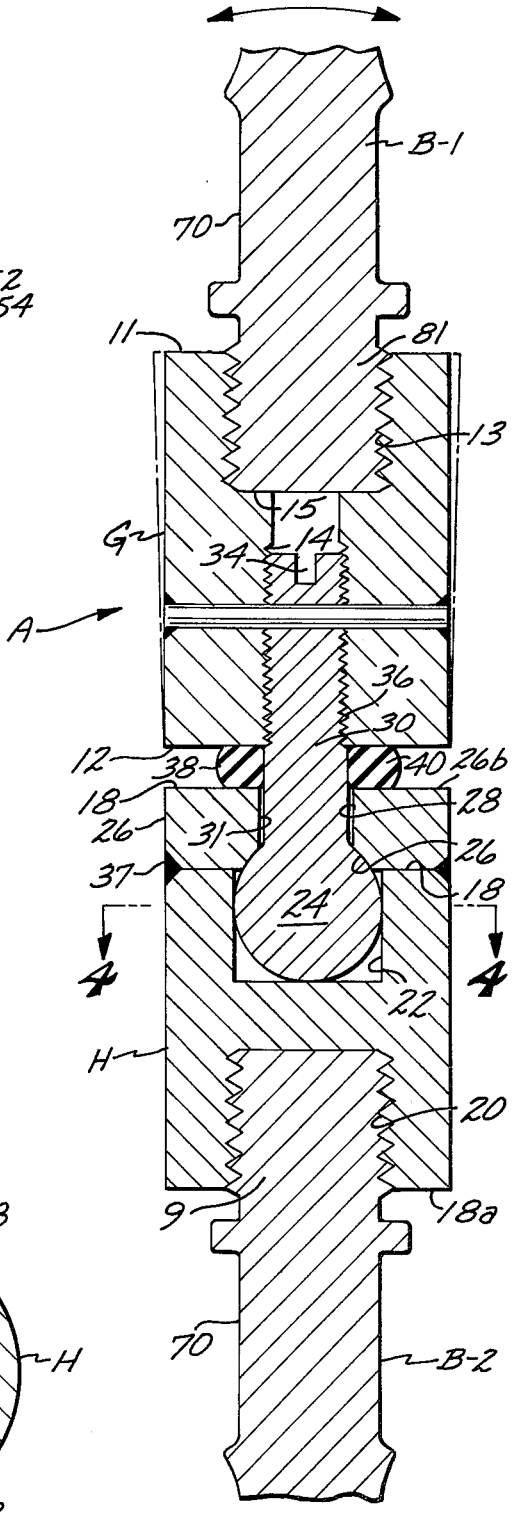
FIG. 3

CONNECTOR ASSEMBLY

BACKGROUND OF THE INVENTION

1. Field of the Invention

Connector Assembly.

2. Description of the Prior Art

Oil well bore holes that extend downwardly from the ground surface to the producing zone are not necessarily straight, but may be crooked, and have a number of dogleg sections therein. Each of such bore holes has a well head at the ground surface that supports a polished rod that is reciprocated by conventional power means. A tubing string depends from the well head and has a number of angularly disposed sections therein that conform generally to the dogleg sections of casing that will normally be present in the bore hole.

A pump is in communication with the lower end of the tubing string and has a piston rod extending upwardly therefrom, which piston rod when reciprocated causes fluid from the formation to be discharged upwardly in the tubing string.

The polished rod of each well head is connected by a sequence of strings of sucker rod to the piston rod of the pump associated with that particular tubing string. The strings of sucker rod are angularly disposed relative to one another. When the strings of sucker rod are stressed longitudinally in actuating the piston rod of the pump, the strings of sucker rod have been found to be subject to substantial twisting. Also, when the angulation of the doglegs in a tubing string are substantial, it is difficult to lower a sucker rod supported elongate pump with an upwardly extending piston rod downwardly through the tubing string to a position there below, and it is also difficult to reverse the operation by drawing the pump upwardly through the tubing strings for repairs and maintenance.

A major object of the present invention is to provide a connector assembly that so removably joins adjacently disposed but longitudinally spaced end portions of upper and lower strings of sucker rod that are angularly disposed to one another that substantial longitudinal stresses may be transmitted from one sucker rod to the other without the sucker rod being subjected to appreciable torsional twisting.

Yet another object of the present invention is to supply a number of the connector assemblies that connect a sequence of sucker rod strings that extend downwardly in a tubing string of an oil well, which tubing string has a number of doglegged sections therein, with the connector assemblies cooperating with the sucker rod strings to transmit longitudinal forces from a polished rod in the well head of the bore hole in which the tubing string is disposed to the piston rod of a pump located at the lower end of the tubing string, and the connector assemblies permitting the strings of sucker rod and pump to be lowered downwardly through the doglegged tubing without difficulty, as well as to permit the tubing strings and pump to be drawn upwardly through the doglegged tubing to permit maintenance work to be performed on the pump.

Another object of the invention is to provide a number of connector assemblies that join a sequence of angularly disposed strings of sucker rod that extend between the polished rod of a well head and a piston rod of a pump located at the lower end of the tubing string, with the connector assemblies permitting reciprocating movement of the strings of sucker rod, without them twisting to the extent that the polished rod and the cable secured to the upper end of the polished rod have a torsional twist imparted thereto.

A further object of the invention is to supply a connector assembly that includes upper and lower boxes that are removably connected to adjacent longitudinally spaced end portion of upper and lower strings of sucker rod that are angularly disposed relative to one another, with the connector assembly transmitting longitudinal forces from one sucker rod string to the other, and the longitudinal spacing between the upper and lower boxes capable of being adjusted by a simple manual operation prior to the upper string of sucker rod being secured to the upper box of the assembly.

Another object of the invention is to supply a connector assembly that includes an upper and lower box, with the lower box pivotally supporting a ball within the confines thereof to allow pivotal movement between the upper and lower boxes, and entry of foreign material into the portion of the lower box in which the ball is situated being substantially eliminated by a resilient ring disposes between the upper extremity of the lower box and the lower extremity of the upper box, with the resilient ring encircling a longitudinally adjustable connector that extends between the upper and lower boxes.

SUMMARY OF THE INVENTION

The connector assemblies of the present invention are preferably used in those situations where there is an elongate oil well pump that has a reciprocating piston rod extending upwardly therefrom. One of the connector assemblies is used to connect the upper extremity of the piston rod to the lower end of the lowermost sucker rod string. The piston rod and the lowermost sucker rod string are reciprocated by strings of angularly disposed sucker rods situated thereabove which are reciprocally mounted in doglegged sections of tubing that extend downwardly in a bore hole of like angulation.

The adjoining ends of the sucker rod strings are removably connected to one another by the connector assemblies of the present invention. The connector assemblies of the present invention so pivotally connect the strings of sucker rod to one another and to the piston rod, that the pump and sucker rod strings may be lowered through a tubing string having doglegged sections of substantial angulation therein without difficulty to dispose of pump adjacent to a fluid producing formation. Also, the connector assemblies permit the sucker rod strings and pump to be moved upwardly through the doglegged sections of tubing to allow the pump to be disposed at the ground surface in a position where maintenance work may be performed thereon. The connector assemblies also serve to prevent torsional twisting of one sucker rod string being transmitted to the string adjacent thereto when the sucker rod strings are longitudinally stressed as they reciprocate in a pumping operation.

BRIEF DESCRIPTION OF THE DRAWINGS

FIG. 1 is a side elevational view of a number of the connector assemblies utilized to join adjacent ends of strings of angularly disposed sucker rod position in a tubing string of substantially like angulation, with the connector assemblies permitting a power actuated polished rod in a well head to reciprocate the sucker rod strings to actuate the piston rod of a pump, and the strings of sucker rod and pump capable of being lowered in and drawn upwardly from a tubing string having doglegged sections therein without difficulty;

FIG. 2 is a fragmentary side elevational view of a connector assembly removably joined longitudinally spaced end portions of two strings of sucker rods;

FIG. 3 is an enlarged longitudinal cross sectional view of the connector assembly shown in FIG. 2 taken on the line 3—3 thereof; and FIG. 4 is a transverse cross sectional view of the invention taken on the line 4—4 of FIG. 3.

DESCRIPTION OF THE PREFERRED EMBODIMENT

One of the connector assemblies A is shown in structual detail in FIG. 3, and in combination with a first string of sucker rod B-1 and second string of sucker rod B-2 in FIG. 1. The first and second strings of sucker rod B-1 and B-2 are shown in FIG. 1 disposed in a tubing string C that has first and second portions C-1 and C-2 that are angularly disposed relative to one another. In FIG. 1 it will be seen that there are a number of second strings of sucker rod B-2 and tubing strings C-2 that are angularly disposed relative to one another.

An elongate pump D is shown in FIG. 1 situated below the lower end of the lowermost second tubing string B-2, which pump is in communication with a fluid producing zone E that has a bore hole M extending upwardly therefrom to a well head L. The pump D includes a reciprocating piston rod 10 that by one of the connector assemblies A is joined to the lower end of the lowermost sucker rod string B-2 as illustrated in FIG. 1.

Each of the connector assemblies A as best seen in FIG. 3 includes a first rigid box G that has an upper end 11, a lower end 12, an internally threaded first bore 13 that extends downwardly from upper end 11, and an internally threaded second bore 14 that extends upwardly from lower end 12. The first and second bores 13 and 14 are axially aligned and define a body shoulder 15 at their junction.

A second rigid box H is provided that has an upper end 18 and a lower end 18*a*, with the second box situated below first box G. A tapped recess 20 extends upwardly in the second box H from the lower end 18*a*. A cavity 22 of cylindrical configuration extends downwardly from the first upper end 18 into second box H as best seen in FIG. 3, with the cavity having a rigid ball 24 rotatably supported therein, and the upper portion of the ball projecting above the upper end 18. A rigid ring 26 is provided that has a lower cancave surface 26*a* that is in rotatable slidable contact with the ball 24 as shown in FIG. 3. The ring 26 has a centered upwardly extending bore 28 therein. An elongate shank 30 extends upwardly from the ball 24 through bore 28 and is of substantially less external diameter than the diameter of the bore 28.

The shank 30 has a first flat end 32 that has a slot 34 of noncircular transverse cross section extending downwardly therefrom into the shank. The shank 30 on the upper portion thereof has threads 36 formed on the exterior surface thereof. The ring 26 as may best be seen in FIG. 3 is by a welding bead 37 rigidly secured to the upper end 18 of the second rigid box H. The ball 24 is snugly disposed in the cavity 22 and slidably engages portions thereof as well as the concave surface 26*a*. The shank 30 and bore 28 cooperate to define annulus space 31 therebetween, the purpose of which will later be explained.

The shank 30 and ball 24 in conbination provide a connector J that pivotally connect the upper and lower boxes G and H when the threads 36 are in engagement with the threaded counterbore 14 as shown in FIG. 3. A resilient ring 38 is disposed between the lower end 12 of first box G and upper end 18 of second box H, and when so disposed encircles a part of the shank 30. The ring 38 when transversely compressed seals the annulus space 31 to prevent entry of particled foreign material into the cavity 22.

The upper end of the first sucker rod string B-1 as may be seen in FIG. 1 is connected by a cenvential fitting K to the lower end of a polished rod 44 that is slidably movable in the well head assembly L. The upper end of the polished rod 44 is connected by a bridle 48 to the lower end of a conventional cable. The well head assembly L has one or more valved fluid outlets 46 as a part thereof through which fluid is discharged from the upper part of the tubing string C.

A base 52 is provided that is supported at a fixed position on the ground surface 54, with the base having a post 56 standing upwardly therefrom that has a pivotal mounting 56*a* on the upper end thereof that supports an elongate beam 58. The beam 58 has a head 58*a* on which a convex surface 58*b* is defined. The cable 50 extends upwardly over the convex surface 58*b* and is secured to the upper part of the head 58*a* by an anchor 66 as shown in FIG. 1.

The base 52 supports a prime mover in the form of a motor or engine 60 that drives a counterweighted arm 62 that has a connecting rod 64 pivotally connected thereto at 64*a*. A pivotal connection 64*b* joins the connecting rod 64 to the beam 58.

In operation, the connector assembly A that joins the string of sucker rod B-1 to the string of sucker rod B-2 will be described. The balance of the connector assemblies A shown in FIG. 1 operate in the same manner as the connector assembly above identified. Both the first and second boxes G and H have pairs of oppositely disposed flat surfaces 68 thereon that may be gripped by a wrench (not shown). Likewise the sucker rod strings B-1 and B-2 have end portions on which pairs of flat surfaces 70 are defined that may be gripped by a wrench (not shown).

Prior to the externally threaded end 8 of sucker rod string B-1 being caused to engage first threaded bore 13, a screwdriver or like elongate tool (not shown) is extended downwardly through bore 13 and counter bore 14 to engage slot 34 and the tool then rotated. By such rotation the lower end 12 may be disposed at a desired spacing relative to the upper surface 26*b* of ring 26. The spacing will normally be such that the resilient ring 38 is compressed between the lower end 12 and upper surface 26*b*.

The threaded end 9 of sucker rod string B-2 is now caused to engage tapped recess 20 as shown in FIG. 3. Threaded end 8 of sucker rod string B-1 is caused to engage the first threaded bore 13 of first box G as shown in FIG. 3.

In actual practice, a connector assembly A will first have the tapped recess 20 engaged by a threaded end of piston rod 10 and the first box G engaged by a threaded end portion 9 of sucker rod string B-2 as shown in FIG. 1. The two sucker rod strings B-2 at their junction be connected by a single connector assembly A, or a pair of longitudinally spaced conductor assemblies that have a length of sucker rod B extending therebetween as shown in FIG. 1.

When the first and second sucker rod strings B-1 and B-2 and pump D are lowered in the tubing string C that has upper and lower angularly disposed sections C-1 and C-2, each of the connector assemblies A will have the upper and lower boxes move angularly relative to one another as they negotiate this dogleg or angulation in the tubing C. Such angular movement of the upper and lower boxes G and H is due to the ball 24 pivoting in the cavity 22 and the shank 30 moving laterally in the annulus space 31. The annulus space 31 must be of sufficient diameter relative to the diameter of shank 30 that the shank will not pressure contact the second box H in negotiating the sharpest angulation in the tubing string C.

As the sucker rod strings B-1, B-2 and piston rod 10 are reciprocated by movement of the polished rod 44, the upward longitudinal stress on the first sucker rod string B-1 is transmitted through first box G, shank 30, ball 24 and second box H to second tubing string B-2 as may be seen in FIG. 3.

In the past when strings of sucker rod are connected by single boxes the upward longitudinal stress imposed thereon on the upstroke of a pumping operation, causes the entire sucker rod assembly to twist, with this twist being transferred through the polished rod and bridle of the actuating cable. However, when connector assemblies A are used to connect adjoining end portions of sucker rod strings as above described, each sucker rod string as it is stressed upwardly is free to twist, but the twist of one sucker rod string is not imparted to the string thereabove.

From the above description it will be seen that strings of sucker rod and the piston rod of a pump may be so pivotally connected that they may be lowered sequentially in a tubing string having a number of doglegs or angulations therein without difficulty to dispose the pump below the tubing string. The reverse operation is also easily performed.

The use and operation of the invention has been described previously in detail and need not be repeated.

What is claimed is:

1. A connector assembly for use is so connecting adjacently disposed, longitudinally spaced, externally threaded end portions of first and second strings of sucker rod that the latter may be moved downwardly through an oil well tubing string that has first and second angularly disposed sections and thereafter be reciprocated therein, said connector assembly substantially eliminating torsional twist from one of said strings of sucker rod being transferred to the other thereof as said first and second strings of sucker rod are longitudinally stressed during concurrent reciprocation thereof, said connector assembly including:

a. an elongate shank and a ball of greater diameter than that of said shank and from which ball said shank extends outwardly, said shank having a flat free end that has a slot of non-circular transverse cross section extending inwardly therefrom, and threads on the exterior of said shank adjacent said free end;

b. a first rigid upwardly disposed box that has an upper and a lower end, a first threaded bore that extends downwardly from said upper end, a threaded counterbore that extends upwardly from said lower end, said first threaded bore engaged by a threaded end portion of said first string of sucker rod, and said threaded counterbore by said threads on said shank;

c. a second rigid box that has upper and lower ends, a tapped recess that extends upwardly from said lower end and is engaged by a threaded end portion of said second sucker rod string, a centered bore that extends downwardly from said upper end of said second box to a cavity in which said ball is snuggly disposed, said shank extending outwardly through said bore, said bore of substantially greater diameter than that of said shank and cooperating therewith to define an annulus space, said shank when said slot is engaged by an elongate tool such as a screwdriver prior to said first sucker rod string being connected to said first box moving said second box longitudinally relative to said first box to have a desired longitudinal spacing between said first and second boxes, and said connector assembly when said first sucker rod string is connected to said first box permitting said first and second sucker rod strings to be reciprocated and longitudinally stressed when angularly disposed relative to one another, with said connector assembly preventing torsional twisting that develops in one of said sucker rod strings being transmitted to the other thereof.

2. A connector assembly as defined in claim 1 in which said second box is formed from first and second portions, said first portion having first and second ends, said tapped recess extending inwardly from said second end, said cavity in which said ball is disposed extending inwardly from said first end, and said second portion being a rigid ring bonded to said first end, said ring having a centered bore therein of greater diameter than that of said shank and through which said centered bore said shank extends.

3. A connector assembly as defined in claim 1 which in addition includes;

a. a resilient sealing ring that encircles said shank and is disposed between said lower end of said first box and said upper end of said second box to prevent particled material moving downwardly through said centered bore into said cavity.

4. In combination with a tubing string that has an upper first portion and at least one lower second portion that extend downwardly in a bore hole to a fluid producing formation, said first and second portions angularly disposed to one another, said first and second portions having adjoining ends thereof connected to one another to define a junction; a pump disposed in said bore hole below said second portion and in communication therewith and with said fluid producing zone, said pump including a piston rod that extends upwardly therefrom and which when reciprocated causes said pump to discharge fluid from said formation upwardly into said lower second portion of said tubing; first and second strings of sucker rod of smaller external diameter than the interior diameter of said tubing movably disposed in said first and second portions, said first and second strings having adjacently disposed, longitudinally spaced threaded end portions adjacent said junction; power means for reciprocating said upper string of sucker rod; a first connector assembly disposed in said tubing adjacent said junction that pivotally connects said first and second strings to permit said first means to reciprocate said first and second strings and said piston rod for said pump to discharge said fluid from said formation upwardly in said tubing, said connector assembly including;

a. a first rigid box that has upper and lower ends, a first longitudinal internally threaded bore that extends downwardly from said upper end and is engaged by said threaded end portion of said first sucker rod string, and an internally threaded counter bore that extends upwardly from said lower end;

a second rigid box that has an upper end and a lower end, a tapped recess that extends upwardly from said lower end, said second box disposed in said tubing string below said first box and longitudinally spaced therefrom, said tapped recess in engagement with said threaded end portion of said second string of sucker rod, and a cavity that extends downwardly in said second box from said upper end thereof;

c. a rigid ball snuggly and rotatably disposed in said cavity;

d. a rigid ring secured to said upper end of said second box and in slidable contact with said ball, said ring having a transverse centered bore therein; and e. an elongate threaded shank that extends upwardly from said ball through said centered bore to engage said internally threaded counterbore, said shank of substantially lesser diameter than that of said bore, said shank extending upwardly above said ring a substantial distance to terminate in a first end that has a slot of non-circular transverse cross section extending downwardly therefrom into said shank, with said first box being longitudinally adjusted to said second box when said slot is engaged by a screwdriver to turn said shank prior to said first sucker rod string being connected to said first box, said first and second sucker rod strings when the latter is connected to said piston rod capable of being lowered downwardly through said angularly disposed first and second tubing string portions to dispose said pump below said second tubing string portion, and said connector assembly permitting said first and sucker rod strings when angularly disposed to be longitudinally stressed to reciprocate said piston rod without torsional twist that develops in one string of sucker rod being transmitted to the other thereof.

* * * * *